US008464899B2

(12) United States Patent
Clarke et al.

(10) Patent No.: US 8,464,899 B2
(45) Date of Patent: Jun. 18, 2013

(54) ZERO CROSS-CONTAMINATION COLLECTOR

(75) Inventors: Darcy O. Clarke, Kent, WA (US); Geoffrey H. Wathen, Corvallis, OR (US)

(73) Assignee: Talyst Inc., Kirkland, WA (US)

( * ) Notice: Subject to any disclaimer, the term of this patent is extended or adjusted under 35 U.S.C. 154(b) by 279 days.

(21) Appl. No.: 12/345,616

(22) Filed: Dec. 29, 2008

(65) Prior Publication Data

US 2009/0194559 A1 Aug. 6, 2009

Related U.S. Application Data

(60) Provisional application No. 61/017,133, filed on Dec. 27, 2007.

(51) Int. Cl.
*B65D 83/00* (2006.01)

(52) U.S. Cl.
USPC ..... 221/133; 221/69

(58) Field of Classification Search
USPC ..... 221/2, 7, 68, 69, 92, 123, 133, 208, 221/252, 281, 312 R
See application file for complete search history.

(56) References Cited

U.S. PATENT DOCUMENTS

| | | | | |
|---|---|---|---|---|
| 2,569,486 | A * | 10/1951 | Mills | 141/105 |
| 3,814,284 | A * | 6/1974 | Flubacker | 221/301 |
| 3,917,045 | A | 11/1975 | Williams | |
| 5,765,606 | A * | 6/1998 | Takemasa et al. | 141/104 |
| 5,769,339 | A * | 6/1998 | Karra | 241/175 |
| 5,771,657 | A | 6/1998 | Lasher | |
| 6,048,086 | A | 4/2000 | Valerino, Sr. | |
| 6,370,841 | B1 | 4/2002 | Chudy | |
| 6,625,952 | B1 | 9/2003 | Chudy | |
| 2002/0015930 | A1 * | 2/2002 | Poe et al. | 431/8 |
| 2003/0183642 | A1 * | 10/2003 | Kempker, Sr. | 221/2 |
| 2004/0112909 | A1 * | 6/2004 | Yamamoto et al. | 221/7 |
| 2008/0265779 | A1 * | 10/2008 | Korobochko et al. | 315/111.21 |
| 2011/0293380 | A1 * | 12/2011 | Stuke et al. | 406/22 |

FOREIGN PATENT DOCUMENTS

| | | | |
|---|---|---|---|
| DE | 422 283 | C | 11/1925 |
| DE | 443 359 | C | 4/1927 |
| DE | 502 581 | C | 7/1930 |
| GB | 437 690 | A | 11/1935 |

OTHER PUBLICATIONS

International Search Report and Written Opinion dated Aug. 6, 2009, issued in corresponding International Application No. PCT/US2008/088490, filed Dec. 29, 2008.

Extended European Search Report, mailed Mar. 22, 2012, issued in corresponding International Application No. PCT/US2008/088490, filed Dec. 29, 2008, 4 pages.

* cited by examiner

*Primary Examiner* — Gene Crawford
*Assistant Examiner* — Kelvin L Randall, Jr.
(74) *Attorney, Agent, or Firm* — Christensen O'Connor Johnson Kindness PLLC

(57) ABSTRACT

The present disclosure provides a collection device having a base with at least first and second openings and at least first and second collector tubes in communication with the at least first and second openings in the base. The collector tubes each have a curvature configured to define a trajectory path for an object descending in the collector tube toward a common target region below the collection device. The collector tubes are configured to be placed into communication with corresponding unique transport tubes/channels/paths, etc., originating at a singulating device.

8 Claims, 6 Drawing Sheets

ZERO CROSS-CONTAMINATION COLLECTOR

CROSS-REFERENCE TO RELATED APPLICATION

This application claims the benefit of U.S. Provisional Patent Application No. 61/017,133, filed on Dec. 27, 2007, the disclosure of which is hereby expressly incorporated by reference.

BACKGROUND

Oral solid packagers are well known as equipment that can produce bar-coded packets of oral solids (including liquids and powders), such as medications, pills, vitamins, candy, nuts, etc. With the bar codes provided on the package, it is possible to track the packets of oral solids dispensed. For instance, if the packager is used to dispense medications, the bar codes are used to track medication so that the hospital knows which patient was given what medication and at what time. This helps reduce the medication error rate in hospital settings.

The newest generation of packagers is referred to as high-speed packagers because they are able to produce bar-coded packages at much higher rates. A high-speed packager can produce unit dosed (one oral solid per package) packages at rates near or above 60 packets a minute or a multi-dose package (more than one oral solid per package) at rates near or above 50 packages a minute.

In a packager, each oral solid is placed in a singulating device that is calibrated specifically for that oral solid. Typically, upon command from the software, an oral solid drops from the singulating device and travels down a common chute or pathway, which leads to the packaging mechanism. The oral solid is then inserted into the package, which is then sealed. Either prior or subsequent to receiving the oral solid, information, including the bar code, is printed on the package.

Using a common pathway to dispense the oral solids causes several problems. Residue from one or more oral solids may remain in the pathway. Subsequent oral solids traveling along the same pathway will be contaminated by the residues from the previous oral solids. This may cause problems when, for instance, an end user receives an oral solid that is contaminated by residue from another oral solid and the end user cannot tolerate the residue. For example, a patient receiving a drug contaminated by the residues of other drugs can have unpredictable reactions for the patient due to allergies or drug interactions. The dust may also be dangerous to the technicians who have to clean the pathways, since daily cleaning is usually a requirement. The same problems occur when the packager delivers liquid medications or medications in powdered form. Oral solids can also jam in common pathways, requiring user intervention. If a jam condition is undetected, an opportunity exists for a package to not receive its intended medication, potentially endangering patients.

A device may be used to deliver each oral solid separately into the packaging mechanism to eliminate any cross-contamination. However, a collection device must often be used to channel the oral solids into a package, which is thereafter sealed by the packaging mechanism. The collection device therefore becomes contaminated with the residues from each oral solid. The collection device may be cleaned, reused or discarded as required, fostering a clean, zero cross-contaminated oral solid delivery path. Thus, there is a need for a device that allows for the delivery of oral solids from multiple, separate points of origin into a single common destination without cross-contamination.

SUMMARY

The present disclosure provides a collection device having a base with at least first and second openings and at least first and second collector tubes in communication with the at least first and second openings in the base. The collector tubes each have a curvature configured to define a trajectory path for an object descending in the collector tube toward a common target region below the collection device. The collector tubes are configured to be placed into communication with corresponding unique transport tubes/channels/paths, etc., originating at a singulating device, This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated by reference to the following detailed description, when taken in conjunction with the accompanying drawings, wherein.

DETAILED DESCRIPTION

Figure 1:
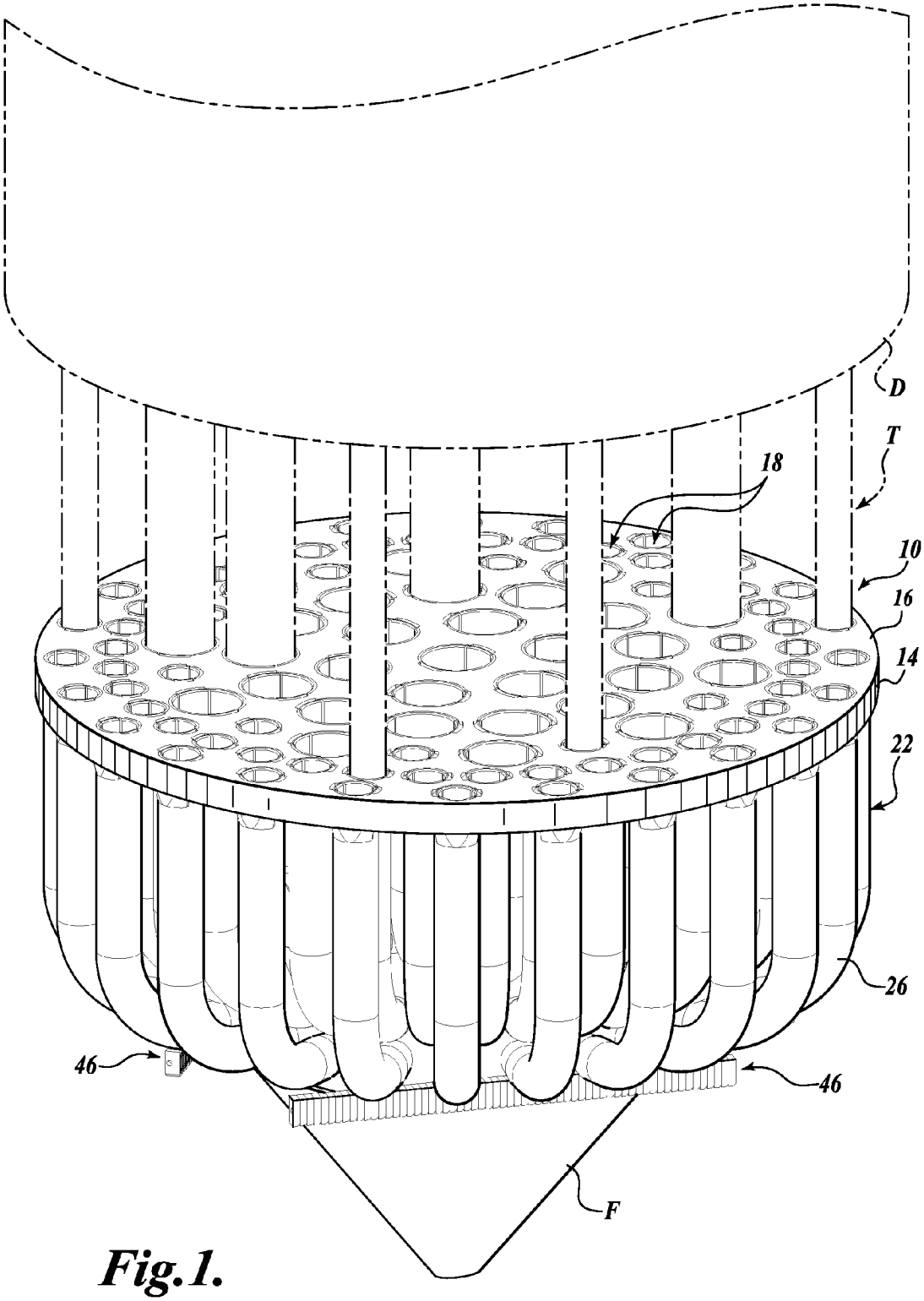
FIG. 1 is an isometric view of a zero cross-contamination collector formed in accordance with one embodiment of the present disclosure.

Referring to FIG. 1, an isometric view of a preferred embodiment of a zero cross-contamination collector 10 formed in accordance with the present disclosure is depicted. The zero cross-contamination collector 10 is adapted for use with a singulating/dispensing device D or any other suitable device or machine that delivers different types of objects, such as oral solids (medications, pills, candy, nuts, etc.), oral liquids (for example, liquid medications), powdered substances (for example, medications in powdered form), etc. (hereinafter collectively referred to as "oral solids"), into a common area by way of unique, separate oral solid transport pathways, channels, tubes, etc. (hereinafter referred to as "oral solid transport tubes T"), without cross-contaminating the oral solids.

The common area may be defined by an intermediate collection device such as a package supplied by a packaging mechanism (not shown) or a funnel F or other suitable device for delivering the oral solids to the packaging mechanism. The common area or intermediate collection device will hereinafter be referred to as a "funnel F" for ease of description. The zero cross-contamination collector 10 receives the oral solids from unique, separate oral solid transport tubes T of the dispensing device D and delivers the oral solids into the funnel F.

The zero cross-contamination collector 10 eliminates the physical interaction of the channels of the dispensing device, thereby providing a means to collect the oral solids without cross-contamination. It should be appreciated that the zero cross-contamination collector 10 may be used to deliver any suitable object into a common area where zero cross-contamination is desired. Moreover, although the collector 100 is referred to throughout this specification as a "zero cross-contamination collector," it should be apparent that such reference is merely a matter of convenience and is not intended to be limiting.

Figure 2:
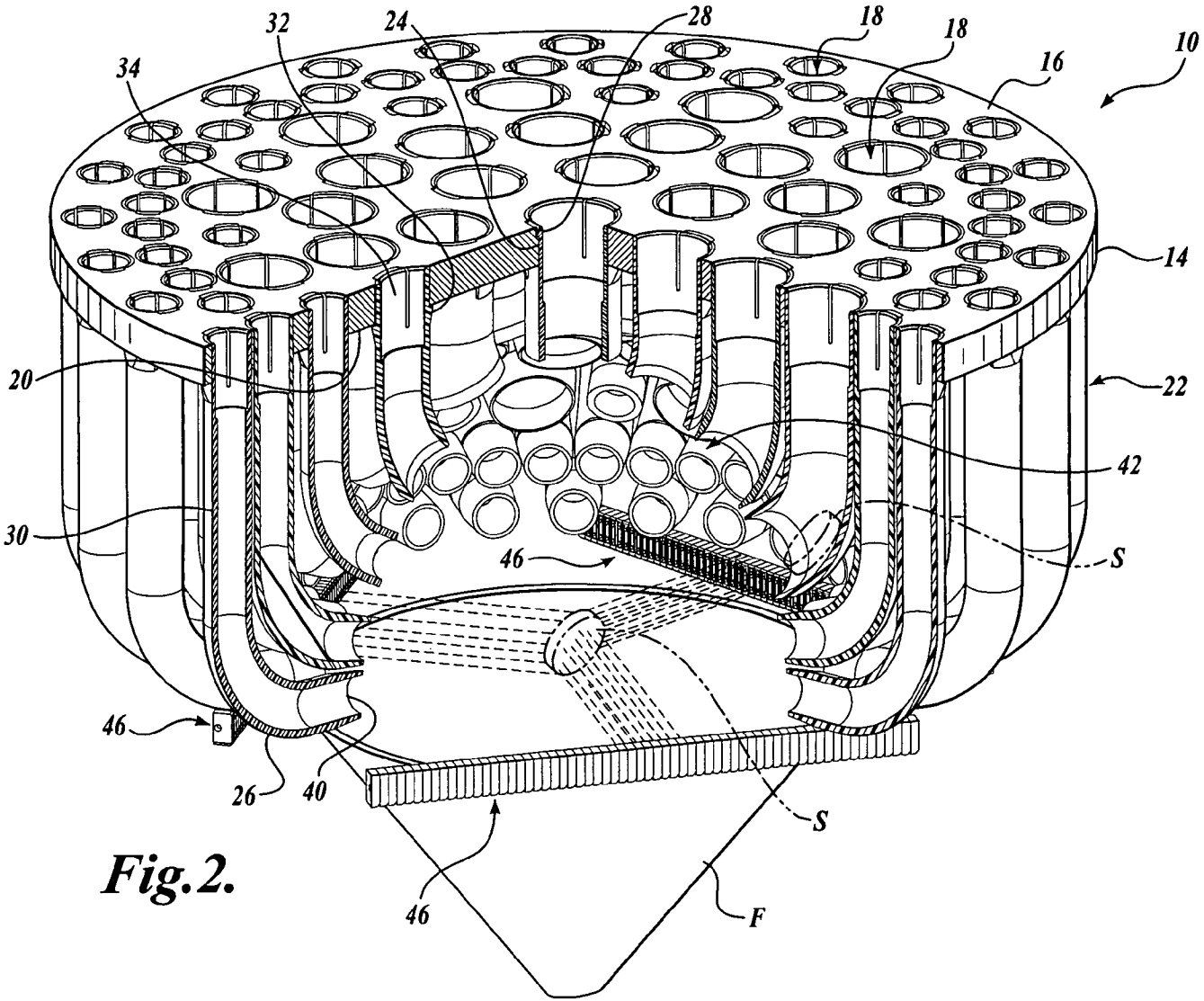
FIG. 2 is an isometric partial cross-sectional view of the zero cross-contamination collector of FIG. 1.
Figure 3:
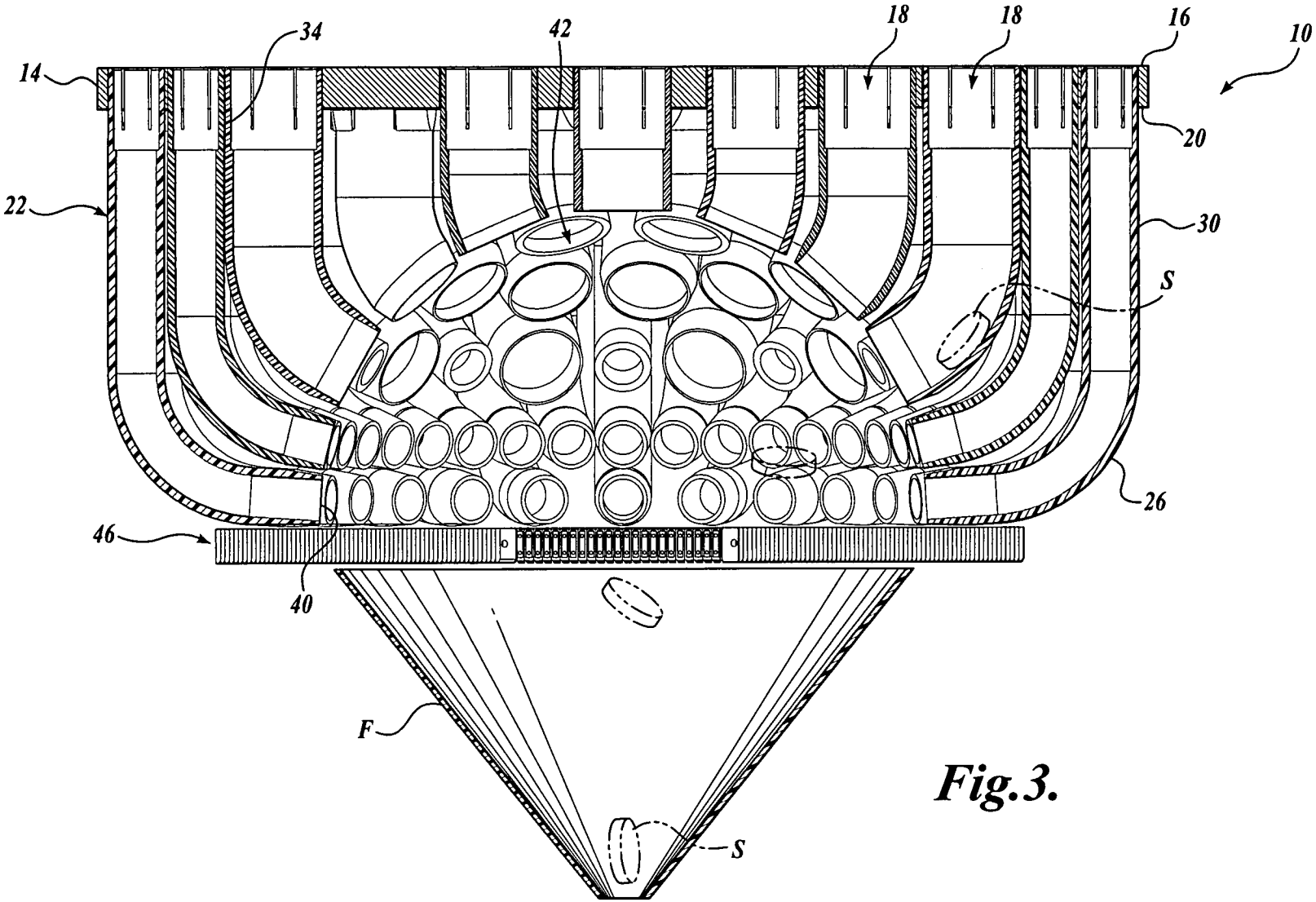
FIG. 3 is a side cross-sectional view of the zero cross-contamination collector of FIG. 1, wherein a pill is shown being dispensed through the zero cross-contamination collector into a collection device.

Referring to FIGS. 2 and 3, the zero cross-contamination collector 10 will now be described in more detail. The zero cross-contamination collector 10 includes a base 14 made of any suitable material well known in the art, such as a chemically inert plastic material or other suitable material that can be easily formed and produced. Applications requiring a more stable product can be made of a chemically inert metal. The base 14 is substantially circular in shape and includes substantially flat upper and lower surfaces 16 and 20 that define a thickness therebetween.

The base 14, when in use with the dispensing device, is positioned relative to a support surface (not shown), such as the ground, such that the upper and lower surfaces 16 and 20 of the base 14 are substantially horizontal with respect to the support surface. Thus, directional terms will be used throughout the disclosure with reference to the position of the base 14, such as upwardly, downwardly, vertically, horizontally, etc. It should be appreciated that these directional terms are used for reference only, and should not be seen as limiting the scope of the present disclosure.

A plurality of openings 18 are formed in the base 14 that extend from the upper surface 16 to the lower surface 20 with the axis of each opening 18 substantially transverse to the upper and lower surfaces 16 and 20. A suitable number of openings 18 are arranged in any preferred pattern on the base 14. Preferably, the openings 18 are arranged in a concentric circular pattern on the base 14 starting with a single opening 18 formed in the center of the base 14. The openings 18 may be any suitable shape and size to be placed into communication with a corresponding oral solid transport tube T of the dispensing device D to accept different medications from the different oral solid transport tubes (see FIG. 1). For instance, the oral solid transport tube T may be substantially circular in cross section to provide a smooth travel path for the dispensed oral solids. Thus, it would be preferable that the openings 18 be substantially circular in shape to match the shape of the tubes and provide a smooth, continuous path for the dispensed oral solid as it travels downwardly towards the funnel F.

The openings 18 may all be the same diameter to provide a uniform interface for mating with oral solid transport tubes T of uniform cross section. In the alternative, the openings 18 may vary in diameter to increase the versatility and/or reduce the footprint of the zero cross-contamination collector 10. For instance, the diameter of the openings 18 may gradually decrease in size from the center of the base 14 towards the outer circumference of the base 14. In this manner, smaller oral solid transport tubes T may be used to dispense smaller oral solids, thereby reducing the overall size of the zero cross-contamination collector 10 and increasing its versatility.

Each of the openings 18 are in communication with a collector tube 22 that extends downwardly from the lower surface of the base 14. The collector tubes 22 provide a curved interface for directing an oral solid traveling down a vertical or substantially vertical oral solid transport tube toward the funnel F. The collector tubes 22 may be formed from any suitable material such as a chemically inert plastic material or other suitable material that can be easily formed and produced.

The collector tubes 22 are substantially circular in cross section, and the outer diameter of the collector tubes 22 are substantially equal to the inner diameter of the openings 18 such that the collector tubes 22 may be tightly received within the openings 18. A notch may be formed within each of the openings 18 that defines a shoulder 24 between the upper and lower surfaces 16 and 20 of the base 14. Each collector tube 22 may include a cantilevered finger 28 extending along an end portion of the collector tubes 22 that passes over the shoulder 24 such that the collector tube 22 is snap fit into the opening 18. A shoulder 32 may also be formed on the exterior surface of each collector tube 22 that engages the lower surface 20 of the base 14 to help ensure that the end of the collector tube 22 is flush with the upper surface 16 of the base 14. However, it should be appreciated that the collector tubes 22 may instead be placed into communication with the openings 18 in any other suitable manner. For instance, the collector tubes 22 may instead be integrally formed with the base 14 during a molding process or other suitable manufacturing process.

Each collector tube 22 preferably includes a vertical portion 30 extending downwardly from the opening 18 and a curved portion 26 extending downwardly and inwardly from the vertical portion 30. Each of the vertical portions 30 of the collector tubes 22 are preferably in substantial vertical alignment when received within the openings 18 such that the collector tubes 22 can be easily placed into communication with corresponding vertical oral solid transport tubes T of a dispensing device D for the delivery of a specific oral solid into the funnel F (see FIG. 1). However, it should be appreciated that the collector tubes 22 may instead extend from the base 14 at any suitable angle to be mated with the oral solid transport tubes T of the dispensing device D.

Each collector tube 22 is adapted to be placed into communication with the end of a dedicated oral solid transport tube T in any suitable manner. For instance, referring to FIG. 1, the oral solid transport tube T may be received within the vertical portion 30 of the collector tube 22 to define a friction fit therebetween. It is preferred that the oral solid transport tube T be mated with the collector tube 22 such that no abrupt edge is defined by the oral solid transport tube or collector tube 22 against which the descending oral solid may catch. More specifically, the collector tube 22 preferably includes an enlarged end portion 34 that has an inner diameter substantially equal to the outer diameter of the oral solid transport tube T such that when the oral solid transport tube T is received within the enlarged end portion 34, the inner surface of the oral solid transport tube T is substantially flush with the inner surface of the collector tube 22. Moreover, the enlarged end portion 34 defines a shoulder against which the end of the oral solid transport tube T may abut to define a continuous transition surface.

As the oral solids descend into the collector tubes 22, the curved portions 26 direct the oral solids toward the funnel F through an end opening 40. The curved portions 26 also define a smooth travel path to help eliminate shattering or lodging of the oral solids after a gravity-driven descent through the oral solid transport tube. The curved portions 26 of the collector tubes 22 gradually increase in radial curvature from the center of the base 14 toward the outer circumference of the base 14. More specifically, the collector tube 22 mated with the center opening 18 has a substantially vertical curved portion 26 (or no curved portion 26) to define an end opening 40 with a substantially vertical axis of opening such that the descending oral solids are dropped directly below into the funnel F. Accordingly, it should be appreciated that the center opening 18 may instead dispense oral solids without the use of a collector tube 22; i.e., the oral solid may instead drop through the opening 18 and directly into the funnel F.

The curved portions 26 of the collector tubes 22 mated with the openings 18 near the outer circumference of the base 14 have a radius of curvature to define an end opening 40 with a substantially horizontal axis of opening. The curved portions 26 of the collector tubes 22 mated with the openings 18 between the center and the outer circumference of the base 14 gradually increase in radial curvature to define end openings 40 increasing from a vertical axis of opening to a horizontal axis of opening.

The collector tubes 22 also increase in length from the center of the base 14 toward the outer circumference of the base 14. In this manner, the ends of the collector tubes 22 collectively define an interior substantially hemispherical cavity 42. The interior substantially hemispherical cavity 42 defines half of a target sphere having a center. The axes of each of the collector tube openings 40 are directed toward the center of the target sphere such that oral solids are ejected through the end openings 40 toward the target sphere center, or toward a common "target region."

The target region is defined by the trajectory path of the oral solids as they are guided by the collector tubes 22 and exit the end openings 40. Thus, the target region is located just below the target sphere center since the oral solids are pulled downwardly by gravitational effects as they are ejected from the openings 40 toward the target sphere center. As shown in FIGS. 2 and 3, a funnel F is located beneath the target region or at least partially surrounding the target region to catch the oral solids as they are ejected from the openings 40. Thus, the oral solids do not contact other oral solids or a common pathway as they are deposited into the funnel F.

Referring to FIG. 2, the zero cross-contamination collector 10 may be used in combination with a drop sensor assembly 46. The drop sensor assembly 46 may be used to detect and track the quantity or quality of oral solids as they are dispensed into the funnel F. The drop sensor assembly 46 is preferably in communication with a computer located within the dispensing machine or located on a computer separate from the dispensing machine. The drop sensor assembly 46 sends signals to the computer for tracking the quantity of oral solids dispensed and/or for indicating an error in dispensing. For instance, if the drop sensor assembly 46 detects more than one oral solid dropping into the funnel F, and only one oral solid was required, the sensor assembly 46 may send a signal to the computer. The computer may then process the signal to indicate to a user that more than one oral solid was dispensed, or that the oral solid dispensed broke into one or more pieces.

Although any suitable drop sensor assembly may be used, the assembly is preferably defined by a plurality of light sensors or other suitable sensors that can detect the oral solid without contacting the oral solid. For instance, the sensor assembly may be comprised of opto-reflective or interrupt sensors, a photodiode array, a light curtain, etc.

Referring to FIGS. 2 and 3, a description of the zero cross-contamination collector 10 in use with a dispensing device suitable for dispensing a specific type of oral solid through a dedicated oral solid transport tube will be hereinafter provided. A funnel F or other collection device specific to an individual or oral solid is first positioned beneath the target region for collecting the dose of dispensed oral solids. With the individual oral solid transport tubes of the dispensing device placed into communication with the collector tubes 22 as described above, the oral solids S are dispensed through the oral solid transport tubes at spaced-apart time intervals which may be predetermined or initiated by a command from a computer in communication with the dispensing device or by any suitable means. The oral solid S accelerates as it descends down the oral solid transport tube of the dispensing device and passes into the dedicated collector tube 22. In this manner, when the oral solid S reaches the curved portion 26 of the collector tube 22, the oral solid S is ejected from the collector tube end opening 40 toward the target region.

The oral solid S drops downwardly into the funnel F due to gravitational effects. As the oral solid S is dropped down into the funnel F, the oral solid S trips a sensor in the sensor assembly. If an error occurs (i.e., more than one oral solid is dispensed), a signal is sent to the computer for processing and notifying a user of the error. After the predetermined quantity of oral solids are dispensed into the funnel F (either for a specific individual or for a specific type of oral solid), the funnel F is moved to deliver the dose of oral solids to a packaging mechanism or other suitable device. The funnel F may be disposed of or reused for the same individual or type of medication. In this manner, the oral solids are delivered to the packaging mechanism without any cross-contamination between types of oral solids or between doses of oral solids.

The zero cross-contamination collector 10 eliminates the physical interaction of the oral solid transport tubes of the dispensing device, thereby providing a means to collect the oral solids without cross-contamination. Moreover, the zero cross-contamination collector 10 converges the oral solid transport tubes for delivery of the oral solids into a funnel F of usable size. It should be appreciated that without the use of the zero cross-contamination collector 10, the funnel F would need to be sized to catch an oral solid being dropped from all the dispensing oral solid transport tubes. Thus, the zero cross-contamination collector also reduces the footprint of the collection device required to funnel the oral solids into the packaging mechanism.

Figure 4:
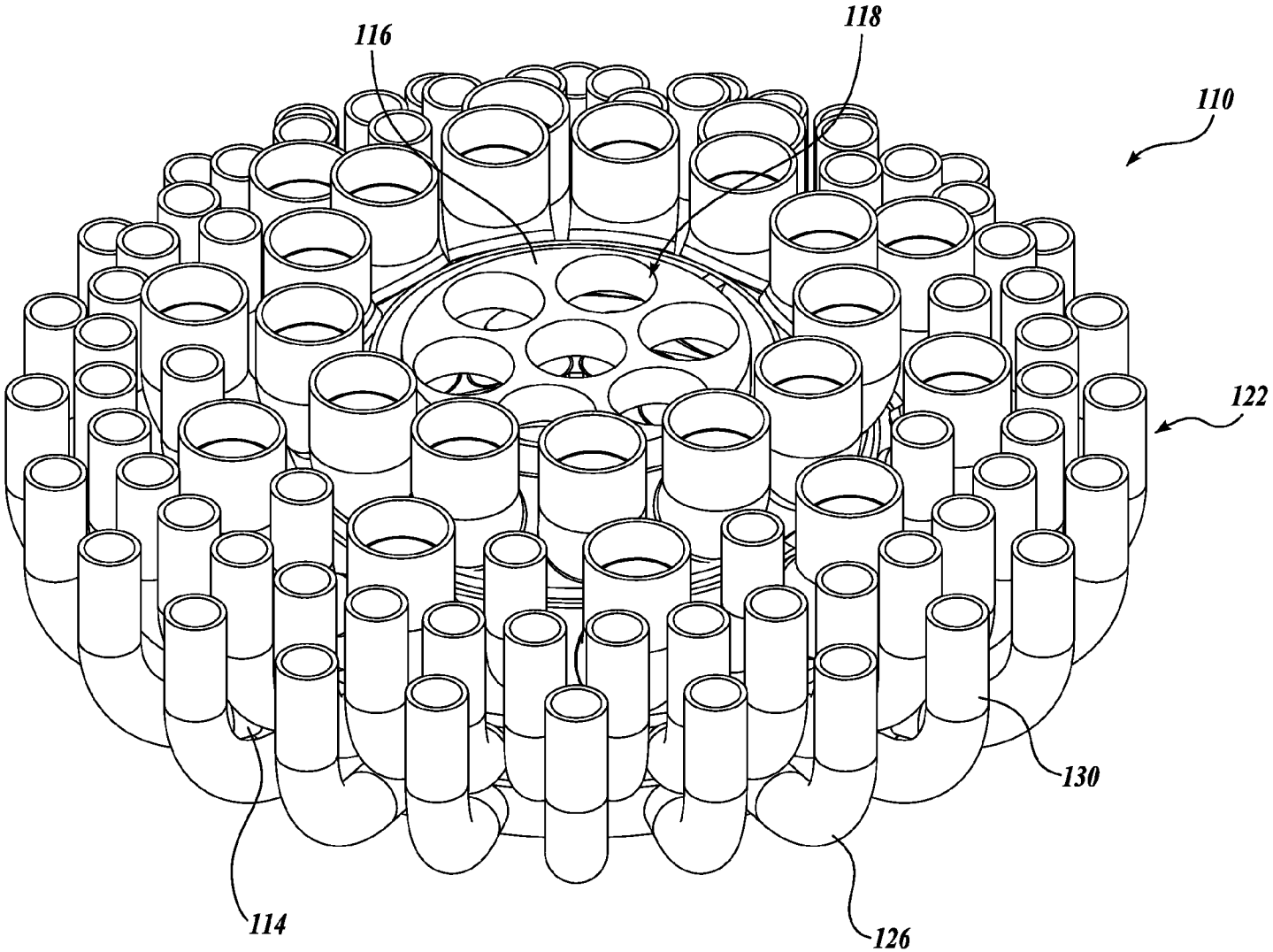
FIG. 4 is an isometric view of a zero cross-contamination collector formed in accordance with a preferred embodiment of the present disclosure.
Figure 5:
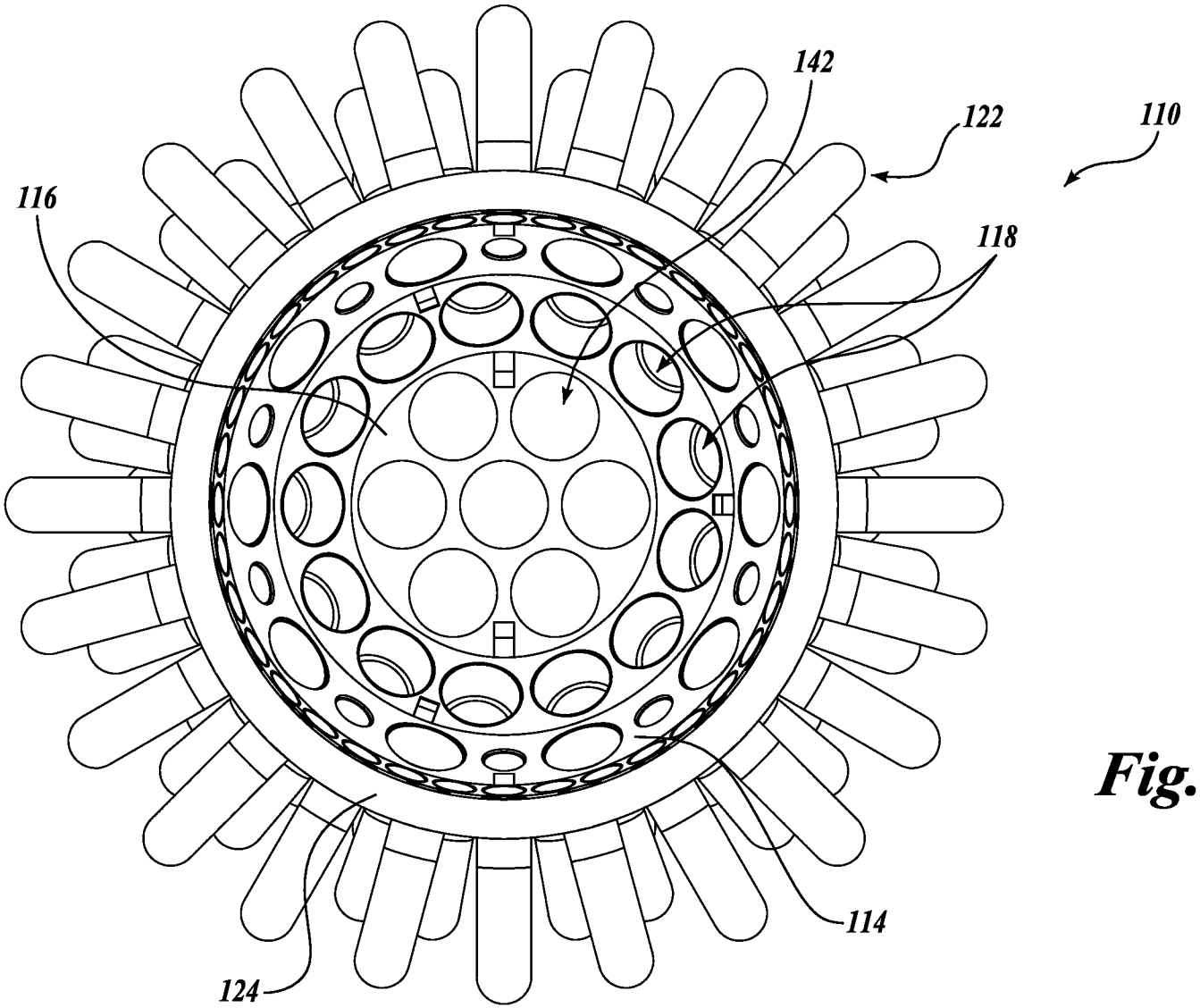
FIG. 5 is a side orthographic view of the zero cross-contamination collector of FIG. 4.
Figure 6:
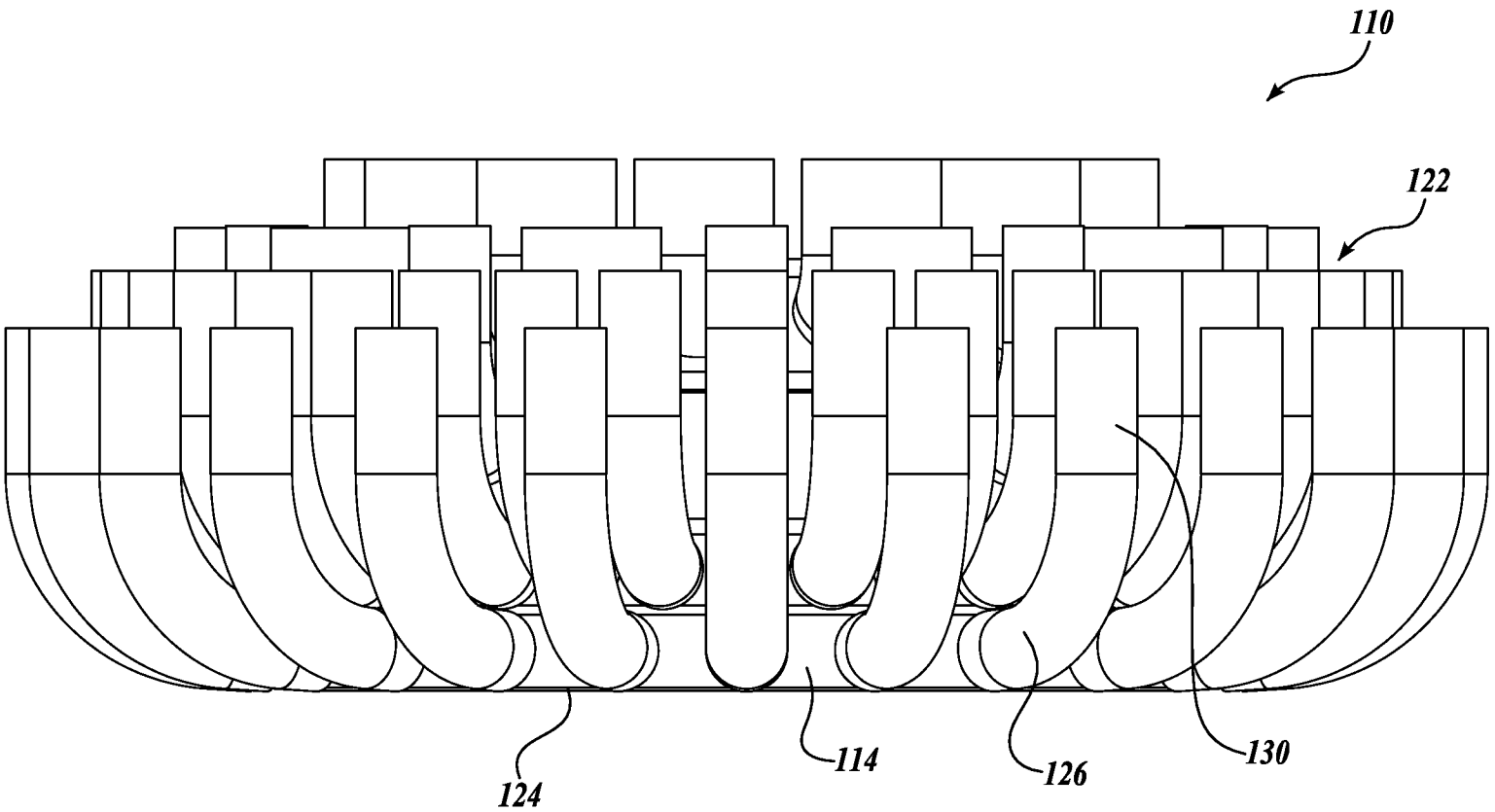
FIG. 6 is a bottom orthographic view of the zero cross-contamination collector of FIG. 4.

Referring to FIGS. 4-6, an alternate embodiment of a zero cross-contamination collector 110 will be hereinafter described. The zero cross-contamination collector 110 includes a hollow base 114 made of any suitable material well known in the art, such as a chemically inert plastic material or other suitable material that can be easily formed and produced. Applications requiring a more stable product can be made of a chemically inert metal. The hollow base 114 is substantially hemispherical in shape and defines a substantially hemispherical interior cavity 142. The hollow base 114 further includes a bottom opening defined by a lower circular edge 124. A top portion of the hollow base 114 is truncated to define a substantially flattened circular top portion 116. The hollow base 114 defines an exterior surface and an interior surface that are substantially identical in shape and geometry.

The hollow base 114, when in use with the dispensing device, is positioned relative to a support surface (not shown), such as the ground, such that the lower circular edge 124 is substantially horizontal with respect to the support surface and the substantially hemispherical interior cavity 142 opens toward the support surface. Thus, directional terms will be used throughout the disclosure with reference to the position of the hollow base 114, such as upwardly, downwardly, vertical, horizontal, etc. It should be appreciated that these directional terms are used for reference only, and should not be seen as limiting the scope of the present disclosure.

A plurality of openings 118 are formed in the hollow base 114 and are arranged in any suitable pattern. Preferably, the openings 118 are arranged in a concentric circular pattern on the hollow base 114 starting with a single opening 118 formed centrally in the flattened circular top portion 116 of the base 114. Moreover, the openings 118 may be any suitable shape and size to accept different medications from different oral solid transport tubes. As described above with reference to the preferred embodiment, the openings 118 are preferably circular in cross section and vary in diameter to be mated with different oral solid transport tubes of the dispensing device.

As can best be seen by referring to FIG. 5, each of the openings 118 formed on the hollow base 114 define an axis of opening directed toward the center of a target sphere that would be defined by two hemispherical interior cavities 142. The openings 118 defined on the substantially flattened circular top portion 116 have a substantially vertical axis of opening, and the openings 118 defined near the lower edge of the hollow base 114 define a substantially horizontal axis of opening, with the openings 118 defined therebetween gradually increasing in angle from a vertical axis of opening to a horizontal axis of opening.

A majority of the openings 118 are preferably in communication with a collector tube 122 that extends outwardly and upwardly from the exterior surface of the hollow base 114. The collector tubes 122 provide a curved interface for mating the openings 118 with a substantially vertical oral solid transport tube of the dispensing device and guiding the oral solids toward a common area as they exit the openings 118. However, it should be appreciated that the openings 118 may instead be placed into direct communication with a curved oral solid transport tube of the dispensing device without the need for a collector tube 122. In this case, the curved oral solid transport tube of the dispensing device would be considered a "collector tube."

The collector tubes 122 may be formed from any suitable material such as a chemically inert plastic material or other suitable material that can be easily formed and produced. However, it is preferred that the collector tubes 122 are formed from the same material as the hollow base 114. Moreover, the collector tubes 122 may be formed independently and thereafter mated with the hollow base 114 in any suitable manner, or the collector tubes 122 may instead be integrally formed with the hollow base 114 during a molding process or other suitable manufacturing process.

Each collector tube 122 preferably includes a curved portion 126 extending from the opening 118 and a vertical portion 130 extending upwardly from the curved portion 126. The curved portions 126 of the collector tubes 122 have a smooth curvature to help eliminate shattering or lodging of oral solids after a gravity-driven descent through the channels. The vertical portions 130 of each of the collector tubes 122 are preferably in substantial vertical alignment such that the collector tubes 122 can be easily mated with corresponding vertical oral solid transport tubes of a dispensing device. However, it should be appreciated that the collector tubes 122 may instead extend outwardly from the base 114 at any suitable angle to be mated with the oral solid transport tubes of the dispensing device.

With the vertical portions 130 of the collector tubes 122 in substantial vertical alignment, and with the axis of the openings 118 changing from vertical to horizontal as described above, the curved portions 126 of the collector tubes 122 gradually increase in radial curvature from the top center of the base 114 toward the lower circular edge 124 of the base 114. As described above, the openings 118 defined on the substantially flat circular portion 116 have a substantially vertical axis of opening. Thus, the curved portions 126 of the collector tubes 122 mated with the openings 118 formed on the substantially flat circular portion 116 would have substantially no radius of curvature. Accordingly, the top openings 118 formed on the substantially flat circular portion 116 may instead be placed into direct communication with the oral solid transport tubes of the dispensing device without the use of a collector tube 122.

Each collector tube 122 may be placed into communication with a corresponding oral solid transport tube of the dispensing device in a substantially similar manner as that described above with reference to the preferred embodiment or any other suitable manner to provide a smooth, continuous path for the dispensed oral solid as it travels downwardly towards the common area. Each channel of the dispensing device dispenses only one specific type of oral solid, eliminating the cross-contamination of "oral solid dust" or other residue.

The oral solids are delivered to the collector tubes 122 and are ejected from the bottom of the openings 118 toward the center of the target sphere defined by the substantially hemispherical interior cavity 142, or a common "target region." The target region is defined by the trajectory path of the oral solids as they are guided by the collector tubes 122 and exit the openings 118. The target region of each collector tube 122 is preferably just below the center of the target sphere since the oral solids are pulled downwardly by gravitational effects as they are ejected from the openings 118 toward the center of the target sphere.

A collection device, package, funnel, etc., specific to an individual or type of oral solid is located in the common area below the target region to receive a single oral solid or combination of oral solids passing through the zero cross-contamination collector 110. In this manner, only oral solids for one individual or oral solids of the same type are cross-contaminated within the collection device or package.

While the preferred embodiment of the present disclosure has been illustrated and described, it will be appreciated that various changes can be made therein without departing from its spirit and scope.

The embodiments of the present disclosure in which an exclusive property or privilege is claimed are defined as follows:

1. A collection device, comprising:

(a) a base having a center, an outer circumference, and a plurality of openings formed within the base, with at least a portion of the plurality of openings located near the center of the base and at least a portion of the plurality of openings located near the outer circumference of the base;

(b) a plurality of collector tubes, each collector tube in communication with one of the plurality of openings in the base, the collector tubes each having a radius of curvature and a length, wherein the collector tubes in communication with the openings located near the outer circumference of the base have a greater radius of curvature and a greater length than the collector tubes in communication with the openings located near the center of the base such that the ends of the collector tubes cooperatively define a substantially hemispherical interior cavity and each collector tube defines a trajectory path for an object descending in the collector tube toward a common target region located substantially below the center of the base.

2. The collection device of claim 1, wherein the base is substantially hemispherical in shape to help define the interior substantially hemispherical cavity.

3. The collection device of claim 1, wherein an intermediate collection device of a dispensing mechanism is positionable below the target region to receive the objects as they are ejected from the collector tubes.

4. The collection device of claim 1, wherein the openings in the base are formed in a pattern of concentric circles.

5. The collection device of claim 1, wherein each tube is in communication with a transport tube of a dispensing device to define an enclosed pathway between the collector tube and the transport tube.

6. The collection device of claim 5, wherein each transport tube is configured to transport one of a plurality of objects.

7. The collection device of claim 6, wherein each of the plurality of objects is a type of oral solid.

8. The collection device of claim 1, further comprising a sensor assembly for detecting an object when it is ejected from the collector tube.

* * * * *